US012778219B2

(12) United States Patent
Allen et al.

(10) Patent No.: US 12,778,219 B2
(45) Date of Patent: Nov. 3, 2026

(54) VARIABLE SECURING GARMENT

(71) Applicants: Rubina Allen, West Orange, NJ (US); Marc Allen, West Orange, NJ (US)

(72) Inventors: Rubina Allen, West Orange, NJ (US); Marc Allen, West Orange, NJ (US)

( * ) Notice: Subject to any disclaimer, the term of this patent is extended or adjusted under 35 U.S.C. 154(b) by 0 days.

(21) Appl. No.: 17/986,677

(22) Filed: Nov. 14, 2022

(65) Prior Publication Data

US 2024/0156183 A1 May 16, 2024

(51) Int. Cl.
*A41D 11/00* (2006.01)
*A41B 13/00* (2006.01)

(52) U.S. Cl.
CPC ..... *A41D 11/00* (2013.01); *A41B 13/005* (2013.01); *A41D 2300/322* (2013.01)

(58) Field of Classification Search
CPC ..... A41D 11/00; A41D 3/06; A41D 15/00; A41D 15/04; A41D 13/0005; A41D 1/082; A41D 2300/322; A41D 13/001; A41D 2600/106; A41D 2600/108; A41D 27/208; A41D 13/02; A41D 3/00; A41D 15/002; A41B 13/005; A41B 9/008; A41B 1/06; A41B 2300/322; A41F 5/00; A41F 17/00; A41F 3/02
USPC ..... 2/70, 80
See application file for complete search history.

(56) References Cited

U.S. PATENT DOCUMENTS 1,570,917 A * 1/1926 Orent ..... A41D 5/00 2/93
1,902,268 A * 3/1933 Scherer ..... A41D 13/02 2/70
2,087,763 A * 7/1937 Liebmann ..... A41D 1/00 2/70
2,152,575 A * 3/1939 Urbon ..... A41D 1/00 2/70
2,559,953 A * 7/1951 Evans ..... A41D 1/00 D2/757
2005/0044605 A1* 3/2005 Hofmann ..... A62B 17/006 2/69
2015/0374049 A1* 12/2015 Lake ..... A41D 15/00 2/458
2016/0324238 A1* 11/2016 Tran ..... A41B 1/06

FOREIGN PATENT DOCUMENTS

WO WO-2014091793 A1 * 6/2014 ..... A41D 1/084

OTHER PUBLICATIONS

Shimizu, Sportswear (Translation), 2014, Clarivate Analytics (Year: 2014).*

* cited by examiner

*Primary Examiner* — Haley A Smith

(74) *Attorney, Agent, or Firm* — Ronald D. Baker; BAKER & CO. PATENT LAW

(57) ABSTRACT

Disclosed is a functional garment that is designed as an article of clothing usable with an infant. The garment is designed to be practical yet functional while attending to infants. The disclosure serves a novel way to care for infants by allowing parents to handle often difficult tasks of managing infants in a welcoming manner. The disclosure includes a top and bottom portion that can be attached or detached by utilizing various attachments to secure the embodiment, a hood, drawstring, two sleeves, two leg portions.

8 Claims, 4 Drawing Sheets

VARIABLE SECURING GARMENT

TECHNICAL FIELD

The presently disclosed embodiments are related, in general, to an article of clothing. More particularly, the presently disclosed embodiments are related to a functional garment that is configured to greatly assist with taking care of an infant.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in-and-of-themselves may also be inventions.

Typically, caring for infants may include various types of garments such as onesies with snap buttons and zippers positioned along one-side of the garment. Traditionally, parents often utilize a number of coats that can be a challenge to apply to babies, especially snow coats or overalls where parents are in a rush and infants are irritable. The existing articles of clothing for infants suffer from several disadvantages such as, for example, requiring complex mechanisms to operate and being difficult to apply to infants due to complex methods of application. This specification recognizes that there is a necessity for a simple and cost-effective garment for infants that can be used that can make parents' lives easier while caring for infants.

Thus, in view of the above, there is a long-felt need to address the aforementioned deficiencies and inadequacies.

Further limitations and disadvantages of conventional and traditional approaches will become apparent to one of skill in the art, through comparison of the described methods with some aspects of the present disclosure, as set forth in the remainder of the present application and with reference to the drawings.

SUMMARY

According to embodiments illustrated herein, there is provided a functional garment for dressing and attending to infants. The garment includes a top portion to include a first zipper configured to fasten and unfasten the top portion, and a second zipper attached to a bottom portion of the garment configured to attach the bottom and top halves of the garment.

The inventive concept is designed in a way that includes two separate portions to be attached to form a unitary garment that encloses the infant's head, torso, arms, and legs, The inventive concept is unique due to its ease at applying and removing the garment from an infant at times for instance, when the infant is sleep or where there are constraints with managing the infant such as during plane flights for instance.

A corollary objective of the embodiment is to provide a garment that may also conceal an infant' body in a manner that will cover an infant's body in a unique fashion while utilizing a combination of zippers and alternate attachment.

These and other features and advantages of the present disclosure may be appreciated from a review of the following detailed description of the present disclosure, along with the accompanying figures in which reference numerals refer to like parts throughout.

BRIEF DESCRIPTION OF DRAWINGS

The accompanying drawings illustrate the various embodiments, methods, and other aspects of the disclosure. Any person with ordinary skills in the art will appreciate that the illustrated element boundaries (e.g., depictions, groups of depictions, or shapes) in the figures represent one example of the boundaries. In some examples, one element may be designed as multiple elements, or multiple elements may be designed as one element. In some examples, an element shown as an internal component of one element may be implemented as an external component in another and vice versa. Further, the elements may not be drawn to scale.

Various embodiments will hereinafter be described in accordance with the appended drawings, which are provided to illustrate and not to limit the scope in any manner, wherein similar designations denote similar elements, and in which.

DETAILED DESCRIPTION

The present disclosure may be best understood with reference to the detailed figures and description set forth herein. Various embodiments are discussed below with reference to the figures. However, those skilled in the art will readily appreciate that the detailed descriptions given herein with respect to the figures are simply for explanatory purposes as the apparatuses, methods, and systems may extend beyond the described embodiments. For example, the teachings presented and the needs of a particular application may yield multiple alternative and suitable approaches to implement the functionality of any detail described herein. Therefore, any approach may extend beyond the particular implementation choices in the following embodiments described and shown.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

Reference throughout this document to "fabric waist band" or similar terms means material that extends from the waist of the bottom portion. The fabric waist band is positioned in a manner to prevent an infant from pinched a zipper while the garment is being worn by an infant. The fabric waist band forms a protective barrier for the infant for injury as well as environmental concerns.

Figure 1A:
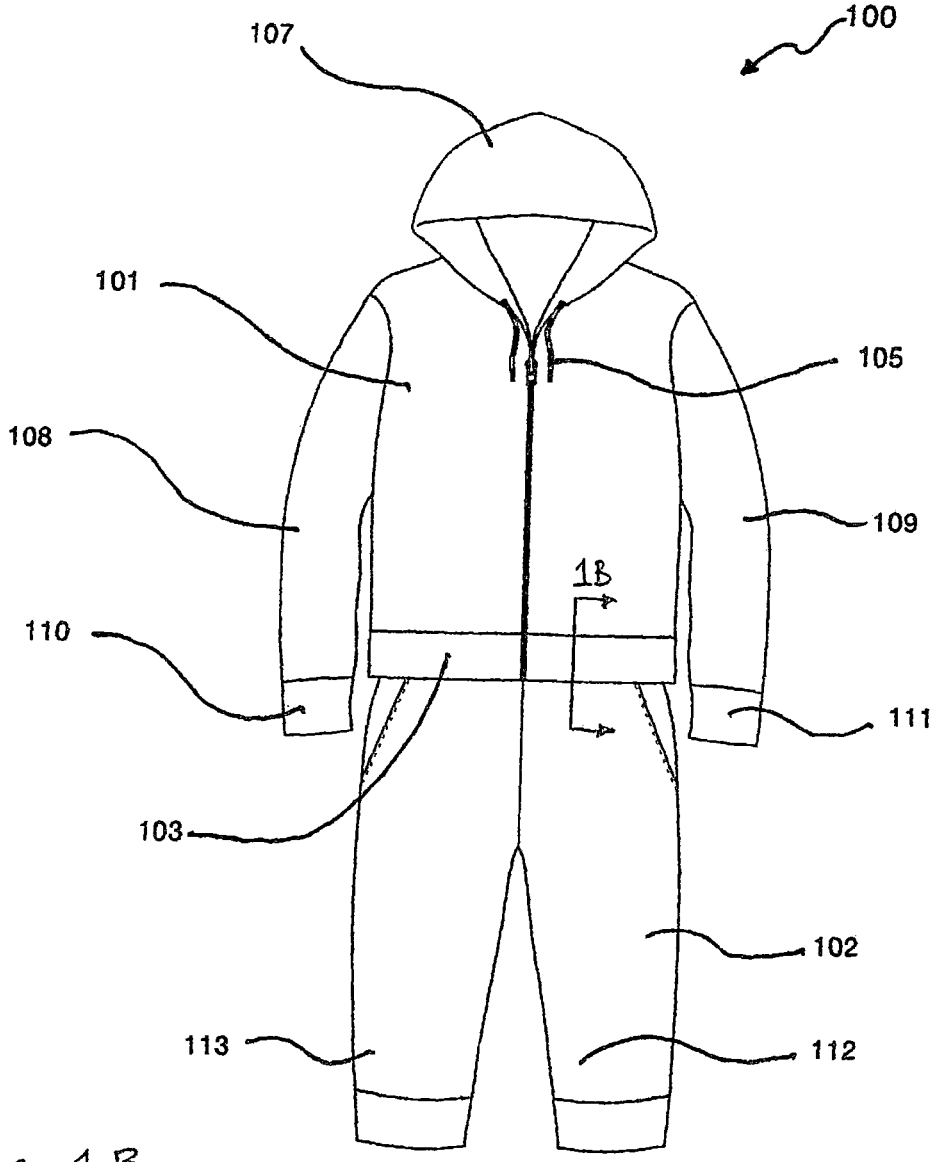
FIG. 1A is a perspective view of the functional garment, in accordance with at least one embodiment.
Figure 1B:
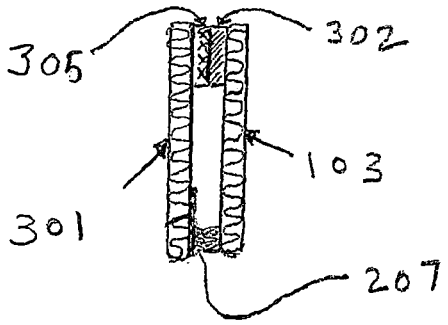
FIG. 1B is a cross-sectional view of how the top portion is securely attachable to the bottom portion of the garment, in accordance with at least one embodiment.

Turning now to FIG. 1A is a perspective view of a functional garment for infants 100 to include a top portion of the garment 101, the top portion makes up the portion of the functional garment that covers the torso and arms of an infant, in accordance with at least one embodiment. FIG. 1A is explained in conjunction with FIGS. 1B and 3. The top portion 101 and bottom portion 102 of the functional garment may be attached at a mid-section area 103 of the top portion 101 to consolidate the top and bottom portions. In an embodiment, the functional garment also includes a drawstring 105 for securing the hood 107 along a user's head. The image also depicts a first sleeve 108, a second sleeve 109, a first wrist portion 110 that is configured to fit around the right wrist of a user, and a second wrist portion 111 that is configured to fit around the left wrist area of a user. The drawing for depicts the first leg covering portion 112, a second leg covering portion 113. In a non-limiting example, the material that the garment is made of can be made of hypoallergenic material, bamboo material, cotton, stain proof material, or the like. It should be understood that any suitable type of material may be utilized. Hereinafter, the functional garment 100 is referred to as a garment for "infants", but it is understood that the term "infants" is exemplary only, and the garment according to exemplary embodiments can be used with infants, toddlers, kindergarteners, or other age groups as well, up to and including adults. The functional garment may be formed from polyester, bamboo, and cotton or any other suitable material. Turning now to FIG. 1B is a perspective view of a cross-sectional view of how the top portion 101 is securely attachable (dual attachment system) to the bottom portion 102 of the garment. FIG. 1B will be further explained in conjunction with FIGS. 1, 2, and 3. The cross-sectional shows the fabric waist portion 301 connected to the top portion 101 by utilizing a second attachment 302 and a first attachment 305. The cross-sectional view also depicts a second zipper and the mid-section area 103 of the top portion 102.

Figure 2A:
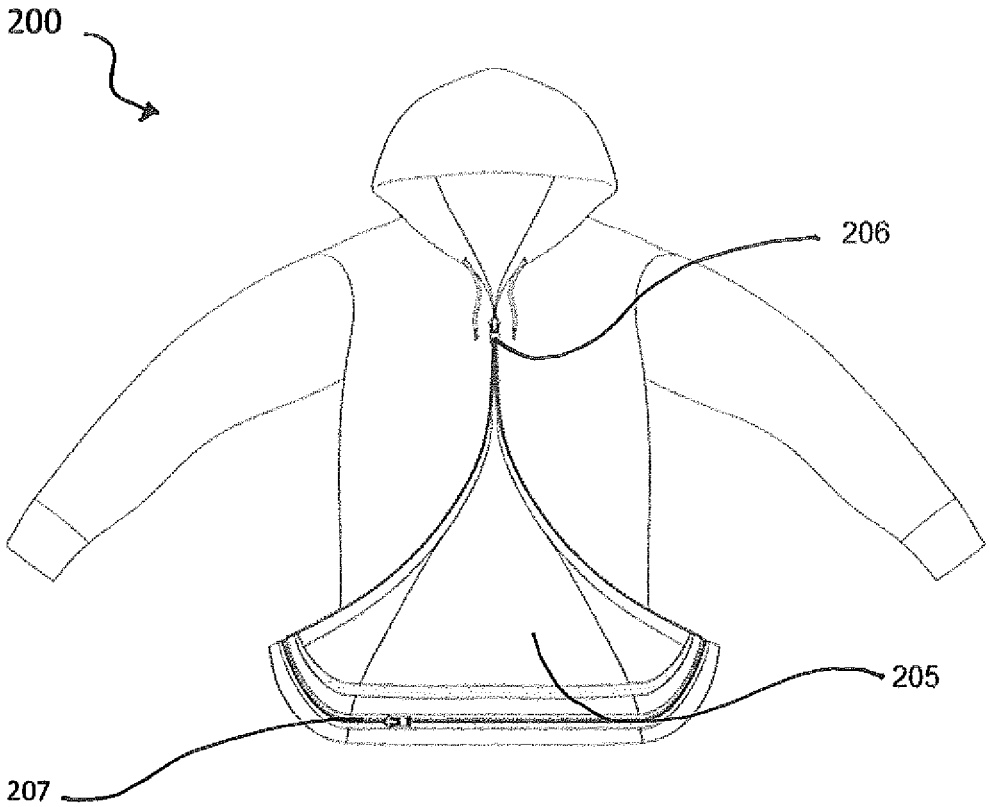
FIG. 2A is a view of the top portion of the functional garment, in accordance with at least one embodiment.

FIG. 2A is a view of the top portion 200 of the functional garment for infants in an open posture displaying an inner panel. The top portion 101 of the functional garment includes a first zipper attachment 206 to enclose the garment along the user's torso. The image also depicts the second zipper 207 designed along the inner panel 205 of top portion 101 of the functional garment. FIG. 2A is explained in conjunction with FIGS. 1 and 3. In an embodiment, the second zipper 207 is adaptable in a manner to receive the top track 207A and bottom track 207B to ensure that both halves (top portion and bottom portion of the garment) will properly cover an infant. Additionally, the image shows the second attachment 302 adjoined along the inner panel 205 of the top portion 101. The second attachment 302 is attachable to the first attachment 305 along the fabric waist band portion 301 positioned above the second zipper 207. The top track 207A is stitched along the inner panel (just below the fabric waist band) of the garment's top portion in a manner to receive the bottom track 207B which is stitched along the upper area of the garment's bottom halve. Both the top track 207A and the bottom track 207B is configured to be attached to form a closed second zipper when the embodiment is fully secured as a unitary garment. It would be appreciated by users that both the top portion 101 and bottom portion(s) 102 will include two attachment mechanisms that are interconnected.

Figure 2B:
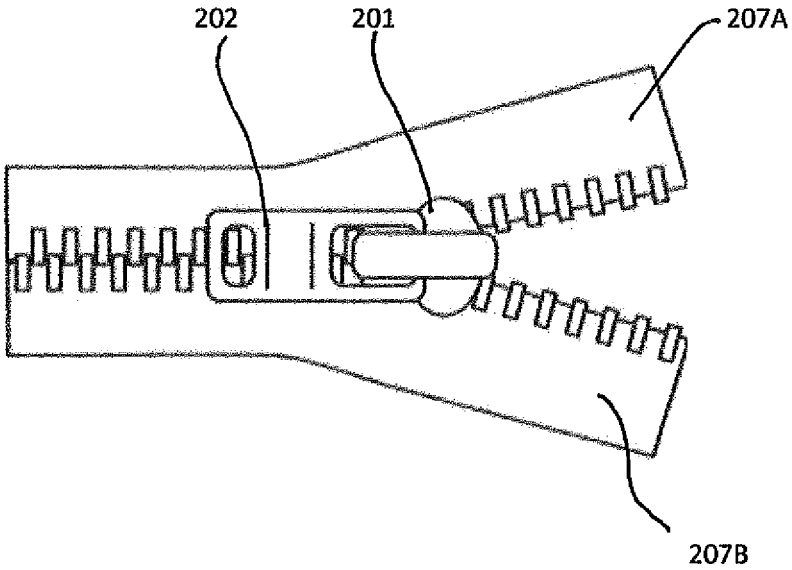
FIG. 2B is an enlarged view of second zipper attachment, in accordance with at least one embodiment.

FIG. 2B is an enlarged view of the second zipper attachment that depicts a portion of the zipper to show the various tracks (207A & 207B) of the second zipper 207, a slider 201, as well as a pull tab 202. FIG. 2B is explained in conjunction with FIGS. 2A and 3. In an embodiment, the second zipper 207 is designed in a manner to form a unitary garment when in use. The top track 207A is attached to the top portion 101 of the garment, and 207B is attached to the bottom portion 102 of the garment.

Figure 3:
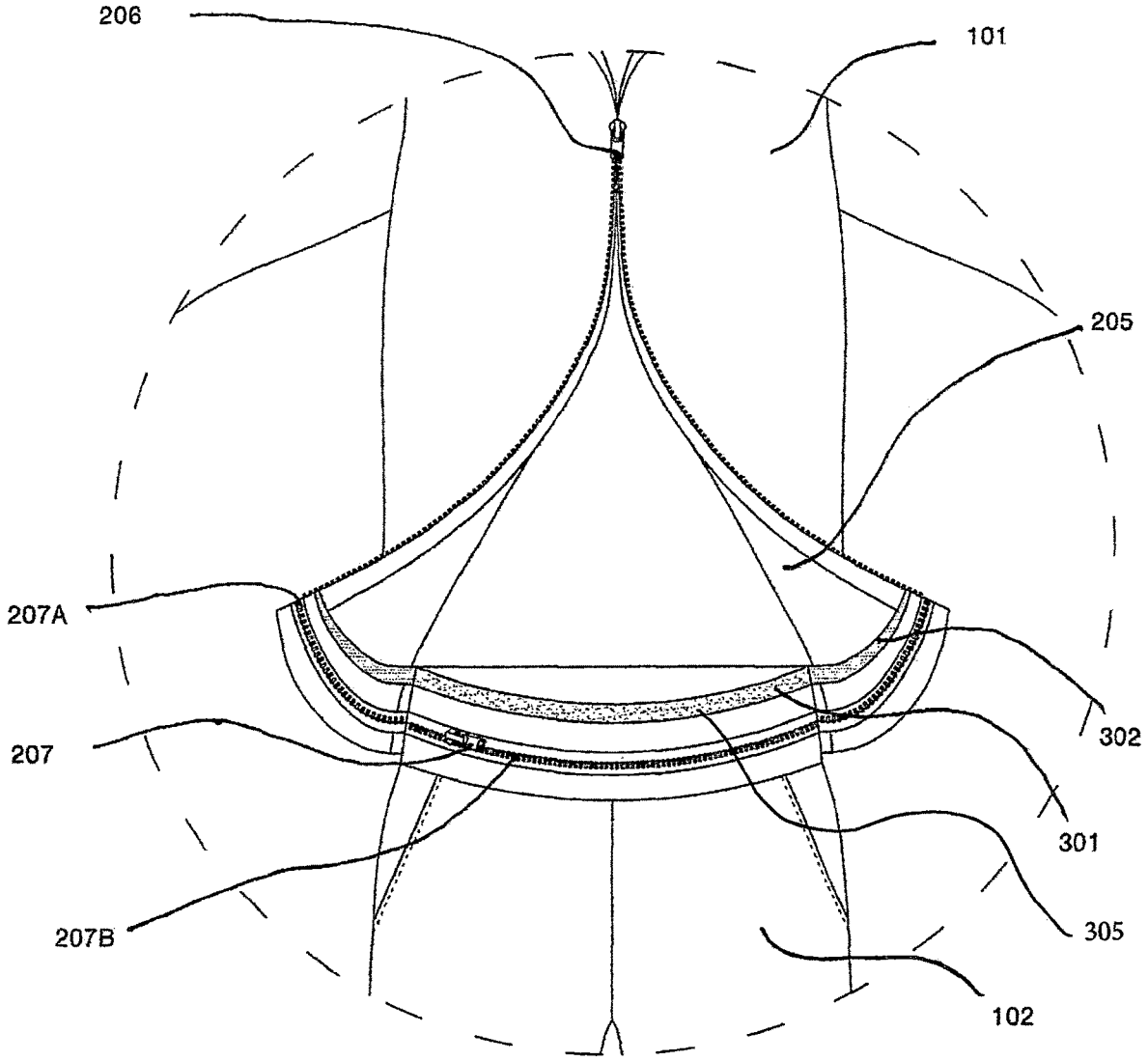
FIG. 3 is a perspective view of the bottom portion and top portion of the functional garment displayed in an open posture to show an inner panel and a top track portion and bottom track portion of the second zipper attachment, in accordance with at least one embodiment.

Turning now to FIG. 3 In an embodiment, the top portion 101 may be attached or detached to the bottom portion 102 of the garment for convenience. In an embodiment, the drawing depicts an upper track portion 207A, and the inner panel 205. In a non-limiting example, the drawing depicts the first zipper 206 (attached to the top portion), the second zipper attachment 207; the bottom portion 102 of the garment and bottom track section 207B is also conveniently attached to the bottom portion 102 of the garment in a manner to engage both halves (top portion and bottom portion) of the functional garment. It is important to note that the bottom and upper portion of embodiment can be attached by mechanisms other than zippers. FIG. 3 is a perspective view of the top and bottom portions of the functional garment which depicts how functional garment is secured while being worn by the user. The bottom portion 102 of the functional garment includes a fabric waist band portion 301 that is designed to fit along the upper perimeter of the bottom portion 102. The fabric waist band portion 301 includes two opposing ends that includes a top insertion end 301A that is the topmost upper edge of the fabric waist band that extends upward along the user's waist in a manner to be adaptable to the top portion of the garment 101. The bottom end 301B is positioned adjacent to the second zipper 207 along lower edge of the fabric waist band portion 301. The fabric waist band portion 301 extends upward at a predefined length covering a portion of a user's waist area to protect against pinching and other injuries that provides comfort for an infant. In a nonlimiting example, the fabric waist band portion 301 is configured to form a barrier to ensure warmth and insulation when the top and bottom portions are connected to each other. FIG. 3 further depicts how the fabric waist band portion 301 attaches to a receiving attachment surface 302 of the inner panel of the upper portion of the functional garment. The depiction shows a plurality of attachments secured to the inner panel 205 here shown as the inside surface of the top portion of the garment 101 and the fabric waist band portion 301 in a manner positioned adjacent to the second zipper attachment 207 while in use. The fabric waist band portion 301 may be attached to the inner panel 205 of the upper portion 101 by a first attachment 305 through the usage of any suitable type of mount or mechanism, such as, for example, hook and loop fasteners, buttons, hook and bar fasteners, clamps, clips, or the like. It should be understood that any suitable type of mechanism, or securement may be utilized. It can be appreciated that the associated zippers and the fabric waist band portion 301 forms a dual attachment system to ensure comfort for an infant.

Figure 4A:
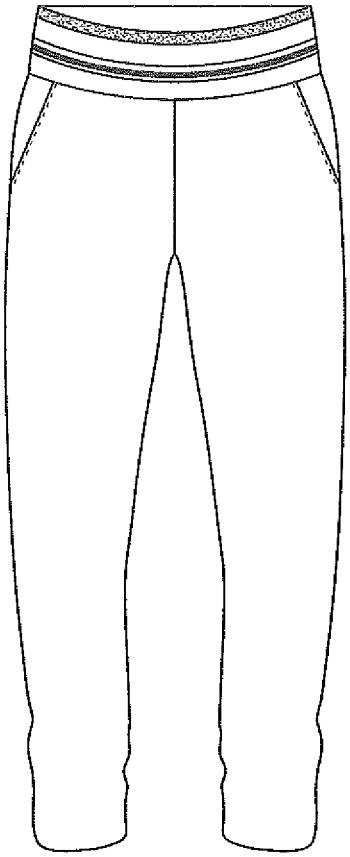
FIGS. 4A, 4B, 4C illustrates perspective views of the bottom portion of the functional garment, in accordance with at least one embodiment.
Figure 4B:
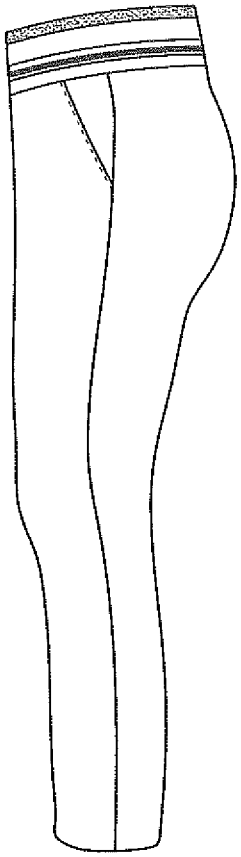
Figure 4C:
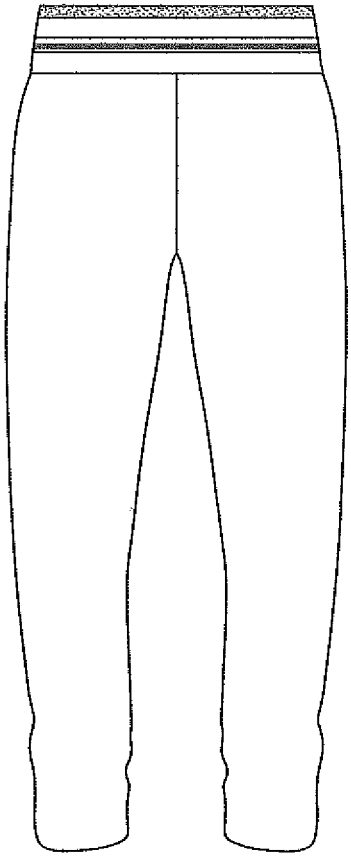

FIGS. 4A, 4B, and 4C illustrates a front, left-side, and rear views of the bottom portion 102 of the functional garment. In an embodiment, the bottom portion 102 is illustrated as a single piece when not engaged with the upper portion 101. FIG. 4A is explained in conjunction with FIG. 3. The illustration shows the fabric waist band portion 301 adjoined to the first attachment 305. As shown in FIGS. 4A, 4B, and 4C the lower portion of the functional garment 102.

One embodiment of the present invention may be made as follows:

obtaining a cloth fabric sewing it in such a manner as to form a top garment portion that is composed of 2 ply of the material stitching the area between the torso portion of the garment and the first and second arm portions stitching in such a manner as to allow the first and second arm portions to be equal in length and size adding an inner panel along the inner surface of the top garment portion sewing the cloth fabric in such a manner as to form a bottom portion that is composed of 2 ply of the material adding a fabric waist band portion to an upper waist portion of the bottom portion stitching a first zipper along the top garment portion in a vertical fashion to fasten and unfasten the top portion stitching a second zipper along the bottom garment portion that includes a top track portion designed along the lower the inner panel of the top garment portion and a bottom track portion of the bottom garment portion adding attachment material along the fabric waist band portion and the inner panel inserting a drawstring along the inner perimeter portion of a hood.

It can be appreciated that the garment utilizes a dual attachment means by utilizing a zipper and another attachment when forming a unitary embodiment by attaching the top and bottom portions of the garment.

Thus, the present invention provides a unique functional garment that is designed to allow an infant to be fitted with an article of clothing that allows for ease of use. Further, the functional garment can be easily applied or removed from an infant by detaching a top portion from a bottom portion for instance where the infant is asleep. Additionally, the functional garment is designed with at least one attachment for securing the garment. It will be appreciated that the focus of the functional garment is to allow a user to apply and remove the garment in a manner that will be easy. The garment also allows for comfort and protection against external elements when securely applied.

A person skilled in the art will understand that the functional garment usable with an infant is described herein for illustrative purposes and should not be construed to limit the scope of the disclosure.

A person with ordinary skills in the art will appreciate that the garment has been illustrated and explained to serve as examples and should not be considered limiting in any manner. It will be further appreciated that the variants of the above-disclosed elements, and other features and functions, or alternatives thereof, may be combined to create other different apparels, garments, or similar applications.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A functional garment for infants, comprising:

a top portion, a bottom portion, a hood attached to said top portion, a drawstring insertable in said hood, a first sleeve attached to said top portion, a second sleeve attached to said top portion, a first leg covering portion attached to said bottom portion, a second leg covering portion attached to said bottom portion, a first wrist portion attached to said first sleeve, a second wrist portion attached to said second sleeve, a first ankle portion attached to said first leg covering portion, a second ankle portion attached to said second leg covering portion, wherein said top portion includes a first zipper and said bottom portion includes a second zipper, a fabric waist band portion positioned along an upper perimeter of said bottom portion; wherein said fabric waist band portion further includes a first attachment; said top portion further comprising an inner panel; wherein said first attachment is configured to attach to said inner panel, said inner panel further including a second attachment that encircles a full width of said top portion; said first attachment is coupled to an outer top edge of said fabric waist band portion and encircles a full width of said fabric waist band portion.

2. The functional garment according to claim 1, wherein said first zipper is configured in a manner to fasten and unfasten said top portion of said functional garment.

3. The functional garment according to claim 1, wherein said second zipper is configured to encircle a waist area of said infant.

4. The functional garment according to claim 1, wherein said fabric waist band portion attaches to said inner panel in a manner to form a protective barrier to protect against pinching of exposed skin by said second zipper during use while also providing an extra barrier of clothing to ensure warmth and insulation.

5. The functional garment according to claim 1, wherein said fabric waist band portion is attachable by said second attachment of said inner panel.

6. A method of manufacturing a functional garment for infants, the method comprising:

manufacturing a top portion configured to cover the torso of the infant, the top portion comprising an inner panel, a hood, a drawstring insertable in said hood, a first sleeve, a second sleeve, and a first zipper configured to fasten and unfasten said top portion to thereby open and close said functional garment, respectively, wherein said inner panel includes a second attachment that encircles a full width of said top portion;

manufacturing a bottom portion, the bottom portion comprising a fabric waist band portion and a second zipper, the second zipper comprising an upper track portion and a lower track portion, wherein the second zipper is configured to attach said top portion to said bottom portion to form a unitary garment, wherein the fabric waist band portion includes a first attachment coupled to an outer top edge of said fabric waist band portion and encircling a full width of said fabric waist band portion, said first attachment being configured to attach to said second attachment of said inner panel;

attaching the upper track portion and the lower track portion;

wherein a first leg covering portion is attached to said bottom portion, a second leg covering portion is attached to said bottom portion, a first ankle portion is attached to said first leg covering portion, a second ankle portion is attached to said second leg covering portion; and wherein said top portion further comprises a first wrist portion attached to said first sleeve and a second wrist portion attached to said second sleeve.

7. The method of manufacturing the functional garment for infants according to claim 6, wherein said fabric waist band portion and a bottom end configured to position said fabric waist band portion adjacent said second zipper when said functional garment is fully applied to said infant, and wherein said first attachment is configured to attach said fabric waist band portion securely to said inner panel.

8. The method of manufacturing the functional garment for infants according to claim 7, wherein said inner panel includes said second attachment configured to attach to said first attachment of said fabric waist band portion in a reciprocal manner, wherein said first zipper comprises a first pull tab attached to a first slider, wherein said second zipper comprises a second pull tab attached to a second slider.

* * * * *